US006098363A

United States Patent [19]

Yaguchi

[11] Patent Number: 6,098,363

[45] **Date of Patent: *Aug. 8, 2000**

[54] SUPPORT PANEL FOR SUPPORTING EXTERNAL WALL FORMING MEMBERS

[75] Inventor: Kazuhiro Yaguchi, Iwatuki, Japan

[73] Assignee: Southco, Concordville, Pa.

[ * ] Notice: This patent issued on a continued prosecution application filed under 37 CFR 1.53(d), and is subject to the twenty year patent term provisions of 35 U.S.C. 154(a)(2).

[21] Appl. No.: 08/901,493

[22] Filed: Jul. 28, 1997

[30] Foreign Application Priority Data

Aug. 21, 1996 [JP] Japan ..... 8-237353

[51] Int. Cl.[7] ..... E04F 13/08

[52] U.S. Cl. ..... 52/385; 52/387; 52/434; 52/562; 52/611; 52/506.08

[58] Field of Search ..... 52/385, 386, 387, 52/506.08, 591.4, 609, 611, 312, 314, 311.2, 391, 604, 605, 675, 591.5, 541, 434, 482, 562; 211/87.01, 94.01

[56] References Cited

U.S. PATENT DOCUMENTS

| | | | |
|---|---|---|---|
| 421,742 | 2/1890 | Marsh | 52/387 |
| 802,727 | 10/1905 | Alschuler | 52/675 |
| 1,915,611 | 6/1933 | Miller | 52/375 |
| 2,832,102 | 4/1958 | Amoruso | 52/386 |
| 3,321,883 | 5/1967 | Pascucci | 52/391 |
| 3,387,422 | 6/1968 | Wanzer | 52/387 |
| 3,427,774 | 2/1969 | Curtis | 52/605 |
| 4,516,373 | 5/1985 | Osawa | 52/387 |
| 4,662,140 | 5/1987 | Porter et al. | 52/385 |
| 4,856,246 | 8/1989 | Shimasaki | 52/387 X |
| 4,987,712 | 1/1991 | Mancuso | 52/387 |
| 5,390,457 | 2/1995 | Sjolander | 52/387 |
| 5,729,943 | 3/1998 | Cambiuzzi | 52/605 X |
| 5,860,257 | 1/1999 | Gerhaher et al. | 52/302.3 X |
| 5,860,261 | 1/1999 | LeBlanc | 52/385 |

FOREIGN PATENT DOCUMENTS

| | | |
|---|---|---|
| 0 484 524 | 5/1992 | European Pat. Off. . |
| 2 583 808 | 12/1986 | France . |
| 35 13 460 | 10/1985 | Germany . |
| 1-121456 | 5/1989 | Japan . |
| 1-263354 | 10/1989 | Japan . |
| 2-37363 | 2/1990 | Japan . |
| 2-128054 | 5/1990 | Japan . |
| 2-194249 | 7/1991 | Japan . |
| 4-140359 | 5/1992 | Japan . |

*Primary Examiner*—Richard E. Chilcot, Jr.
*Attorney, Agent, or Firm*—Paul & Paul

[57] ABSTRACT

A support panel for supporting external wall forming members such as bricks to form an external wall of a building structure. External wall forming members have elongated lateral extensions projecting on the side surfaces thereof. The support panel has a back plate and rows of engaging members with bent fingers arranged such that the external wall forming members can be inserted between two adjacent rows of engaging members and the lateral extensions are covered by the fingers. The support panel can be fabricated by pressing or bending a flat sheet metal, and the engaging members are integral with the back plate. Therefore, the support panel can be easily applied to a wall of a building structure and the external wall forming members can be easily laid to complete an external wall.

8 Claims, 17 Drawing Sheets

SUPPORT PANEL FOR SUPPORTING EXTERNAL WALL FORMING MEMBERS

BACKGROUND OF THE INVENTION

1. Field of the Invention

The present invention generally relates to an external wall of a building or a house and, in particular, it relates to a support panel to secure external wall forming members such as bricks, tiles and stones, to complete an external wall of a building.

2. Description of the Related Art

Materials such as bricks and tiles have a fireproof property, and are adapted to complete an external wall of a building or a house. However, it is difficult to attach external wall forming members such as bricks and tiles to a wall surface of a building. In known methods to attach external wall forming members to a wall surface of a building, recesses or projections are provided in rear surfaces of tiles and the rear surfaces of the tiles are attached to the external surface, or tiles are attached to the external surface using metal fittings. Regarding relatively heavy external wall forming members such as bricks, since it is necessary to reliably fix the external wall forming members to the wall, L-shaped fittings are fixed along the wall and the bricks rest on the L-shaped fittings one by one to stack the bricks.

However, in this method, a great amount of mortar is necessary, and it is necessary to fix the L-shaped fittings at a vertically constant pitch, so the work for arranging the L-shaped fittings in position is difficult and a working efficiency is low since the external wall forming members may drop during the work.

SUMMARY OF THE INVENTION

The object of the present invention is to solve the above described problems and to provide a support panel by which relatively heavy external wall forming members such as bricks can be easily and reliable attached to an external wall of a building, and by which working efficiency and safety during construction can be improved.

Another object of the present invention is to provide an external wall forming member which is adapted to complete an external wall of a building, using a support panel.

According to the present invention, there is provided a support panel for supporting a plurality of external wall forming members, each external wall forming member having a generally rectangular parallelepiped shape including a main surface, a rear surface, side surfaces, and elongated lateral extensions projecting on the side surfaces, the elongated lateral extensions having minor surfaces and rear surfaces, the main surface being higher than the minor surfaces. The support panel comprises a back plate adapted to make contact with the rear surface of the external wall forming members, at least one first engaging member extending substantially perpendicular to the back plate and along a first line, and at least one second engaging member extending substantially perpendicular to the back plate and along a second line parallel to the first line. The at least one first engaging member and the at least one second engaging member are integrally formed with the back plate as a unit, whereby a plurality of external wall forming members are secured between the at least one first engaging member and the at least one second engaging member.

In the preferred embodiment, preferably, each of the at least one first engaging member and the at least one second engaging member comprises a flat strip.

Preferably, the support panel further comprises at least one third engaging member extending substantially perpendicular to the back plate and along a third line parallel to the second line, the at least one third engaging member being integrally formed with the back plate, the at least one first engaging member and the at least one second engaging member as a unit, whereby a plurality of external wall forming members being secured between the at least one second engaging member and the at least one third engaging member.

Preferably, the at least one first engaging member and the at least one second engaging member have mutually inwardly bent fingers to engage with the minor surfaces of a plurality of external wall forming members inserted between the at least one first engaging member and the at least one second engaging member, the at least one second engaging member and the at least one third engaging member have mutually inwardly bent fingers to engage with the minor surfaces of a plurality of external wall forming members inserted between the at least one second engaging member and the at least one third engaging member.

Preferably, each of the at least one first engaging member and the at least one second engaging member comprises an engaging member having a length greater than a total length of a plurality of external wall forming members.

Preferably, each of the at least one first engaging member and the at least one second engaging member comprises a plurality of engaging members.

Preferably, a plurality of engaging members are arranged per one external wall forming member.

Preferably, a plurality of engaging members of each of the at least one first engaging member and the at least one second engaging member have a first group of fingers bent in one direction and a second group of fingers bent in the direction opposite to the one direction.

Preferably, the engaging members are formed by pressing the material of the back plate so that the engaging members stand on the back plate and cutouts are formed adjacent to the engaging members, the cutouts adjacent to the engaging members having the first group of fingers are located on one side of the line along which the engaging members extend, the cutouts adjacent to the engaging members having the second group of fingers are located on the other side of the line.

Preferably, the back plate is corrugated to form at least one groove between the first and second lines and to form at least one groove between the second and third lines.

Preferably, the support panel is formed by pressing, the support panel is formed by sheet metal bending, or the support panel is formed by molding.

According to a further aspect of the present invention, there is provided a support system comprising a central support panel and an upper support panel. The central support panel comprises a back plate, at least one first engaging member extending substantially perpendicular to the back plate and along a first line, at least one second engaging member extending substantially perpendicular to the back plate and along a second line parallel to the first line, and at least one third engaging member extending substantially perpendicular to the back plate and along a third line parallel to the second line. The at least one first engaging member, the at least one second engaging member and the at least one third engaging member are integrally formed with the back plate as a unit, whereby a plurality of external wall forming members are secured between the at least one first engaging member and the at least one second engaging member. In addition, the upper support panel comprises a back plate, and at least one fourth engaging member extending substantially perpendicular to the back plate and along a fourth line. The at least one fourth engaging member is integrally formed with the back plate as a unit, whereby a plurality of external wall forming members being secured between the at least one first engaging member and the at least one fourth engaging member when the upper support panel is arranged adjacent to the central support panel so that the fourth line is parallel to the first line.

Preferably, the support system further comprises a lower support panel which comprises a back plate, and at least one fifth engaging member extending substantially perpendicular to the back plate and along a fifth line. The at least one fifth engaging member being integrally formed with the back plate as a unit, whereby a plurality of external wall forming members being secured between the at least one third engaging member and the at least one fifth engaging member when the lower support panel is arranged adjacent to the central support panel so that the fifth line is parallel to the third line.

According to a further aspect of the present invention, there is provided an external wall forming member having a generally rectangular parallelepiped shape including a main surface, a main rear surface, side surfaces, end surfaces, elongated lateral extensions projecting on the side surfaces, and an end extension projecting on one of the end surfaces, the elongated lateral extensions having minor surfaces and rear surfaces, the end extension having a minor surface and a rear surface, the main surface being higher than the minor surfaces of the elongated lateral extensions and the end extension.

Preferably, one of the elongated lateral extensions has a width greater than that of the other elongated lateral extension, the minor surfaces of the elongated lateral extensions and the end extension being continuous to and flush with each other, the rear surfaces of the elongated lateral extensions and the end extension being continuous to and flush with the main rear surface.

According to a still further aspect of the present invention, there is provided a support panel for supporting a plurality of external wall forming members, each external wall forming member having a generally rectangular parallelepiped shape including a main surface, a rear surface, side surfaces, and an elongated lateral extension projecting on one of the side surfaces, the elongated lateral extensions having minor surfaces and rear surfaces, the main surface being higher than the minor surfaces. The support panel comprises a back plate adapted to make contact with the rear surface of the external wall forming members, at least one first engaging member extending substantially perpendicular to the back plate and along a first line, and at least one second engaging member extending substantially perpendicular to the back plate and along a second line parallel to the first line. The at least one first engaging member and the at least one second engaging member are integrally formed with the back plate as a unit, whereby a plurality of external wall forming members are secured between the at least one first engaging member and the at least one second engaging member.

Preferably, the support panel further comprises at least one third engaging member extending substantially perpendicular to the back plate and along a third line parallel to the second line parallel, the at least one third engaging member being integrally formed with the back plate, the at least one first engaging member and the at least one second engaging member as a unit, whereby a plurality of external wall forming members being secured between the at least one second engaging member and the at least one third engaging member.

BRIEF DESCRIPTION OF THE DRAWINGS

The present invention will become more apparent from the following description of the preferred embodiments, with reference to the accompanying drawings in which.

DESCRIPTION OF THE PREFERRED EMBODIMENTS

Figure 1:
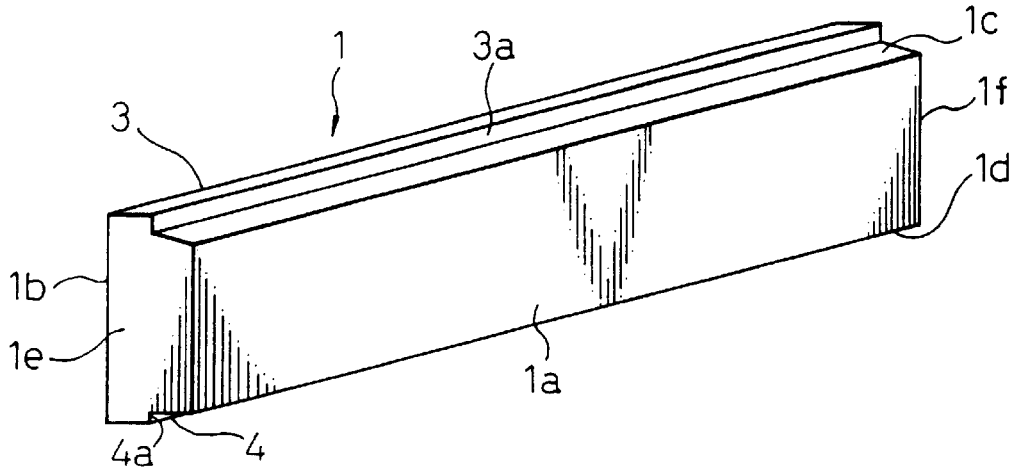
FIG. 1 is a perspective view of an external wall forming Member in the form of a brick.
Figure 2:
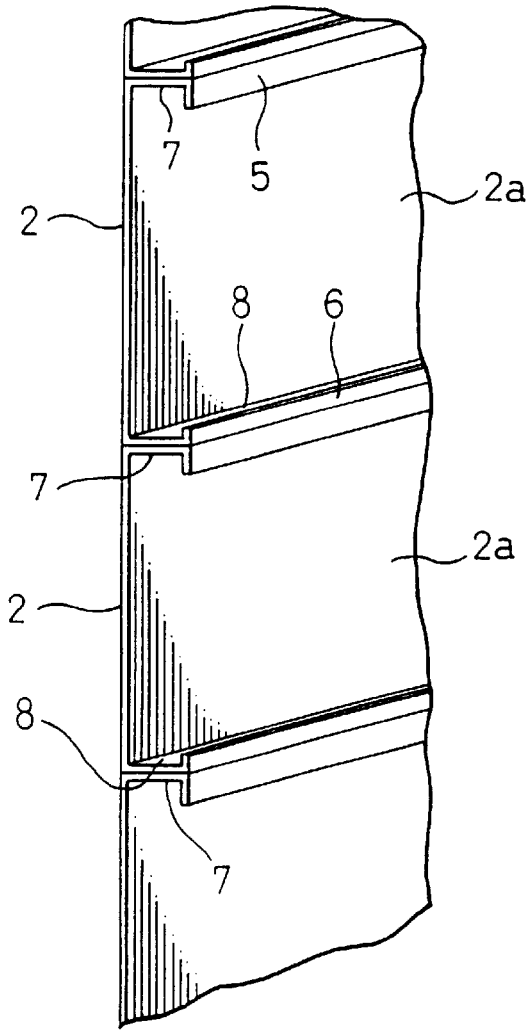
FIG. 2 a perspective view of a support panel according o the first embodiment of the present invention.
Figure 3:
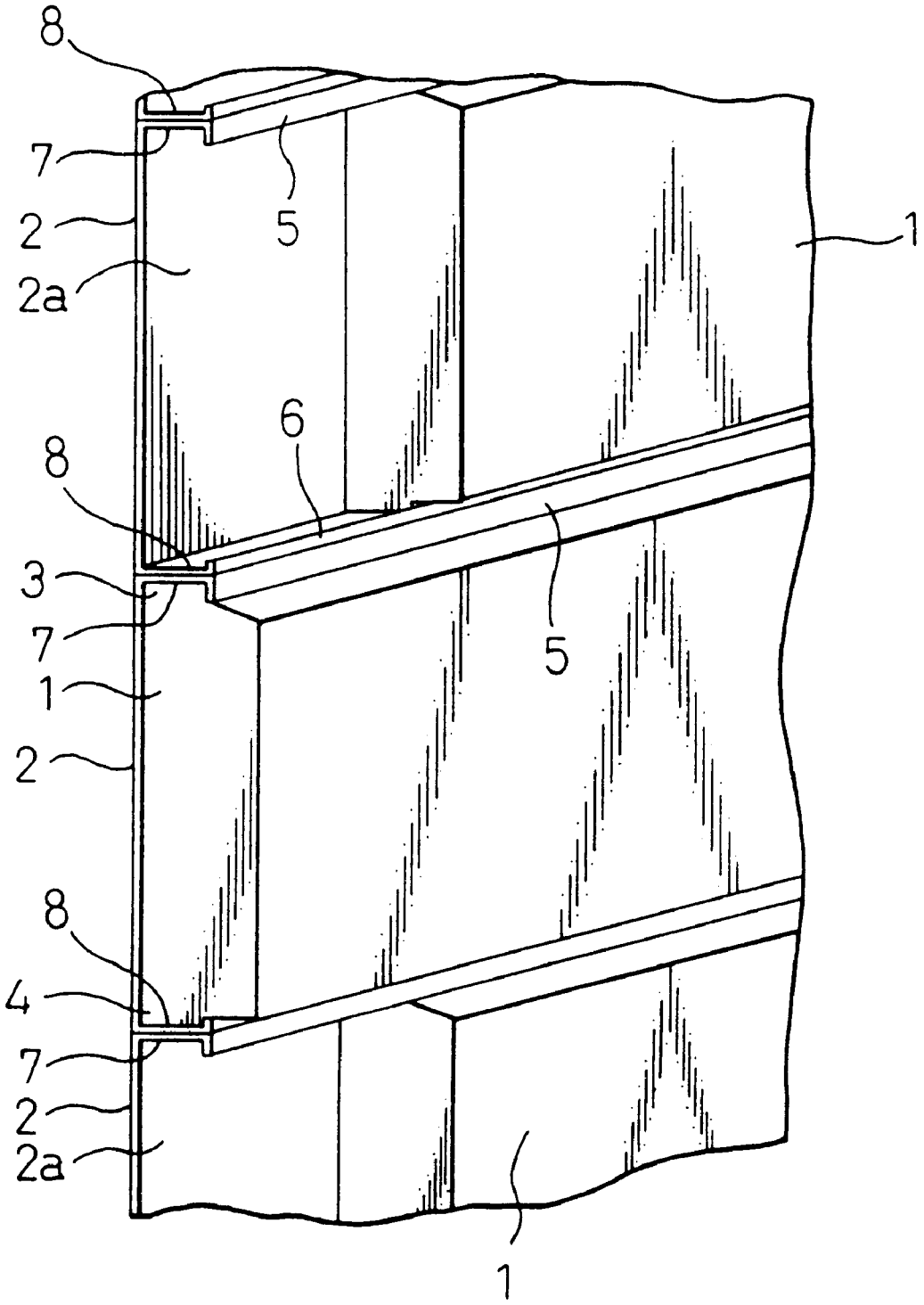
FIG. 3 is a perspective view of the stacked support panels of FIG. 2 and external wall forming members of FIG. 1 secured to the support panels.

FIG. 1 shows an external wall forming member 1 which is a brick in the illustrated example. FIG. 2 shows a support panel 2 according to the first embodiment of the present invention. FIG. 3 shows the stacked support panels 2 and the external wall forming members 1 secured to the support panel 2 to complete an external wall of a building structure.

In FIG. 1, the external wall forming member 1 has a generally rectangular parallelepiped shape and elongated lateral extensions 3 and 4. The external wall forming member 1 has a main surface 1*a*, a rear surface 1*b*, side surfaces 1*c* and 1*d*, and end surfaces 1*e* and 1*f*. The elongated lateral extensions 3 and 4 project on the side surfaces 1*c* and 1*d* near the rear surface 1*b*, and have minor surfaces 3*a* and 4*a*, side surfaces, rear surfaces flush with the rear surface 1*b*, and end surfaces flush with the end surfaces 1*e* and 1*f*. The main surface la is higher than the minor surfaces 3*a* and 4*a*. The external wall forming member 1 is arranged in this position when it is attached to a vertical component of a building structure. The width of the upper lateral extension 3 is greater than that of the lower lateral extension 4.

In FIG. 2, the support panel 2 is fabricated from a metal sheet such as stainless steel by bending the metal sheet in a C-shape. The metal sheet is once bent substantially 90 degrees to form first and second engaging members 7 and 8, and further bent substantially 90 degrees to form first and second securing fingers. The support panel 2 thus comprises a back plate 2*a* adapted to make contact with the rear surface 1*b* of the external wall forming member 1, the first engaging member 7 in the form of a straight metal strip extending substantially perpendicular to the back plate 2*a* and along a first line with the inwardly bent finger 5 at the free end thereof, and the second engaging member 8 in the form of a straight metal strip extending substantially perpendicular to the back plate 2*a* and along a second line parallel to the first line with the inwardly bent finger 6 at the free end thereof. The distance between the first and second engaging members 7 and 8 is substantially identical to the width of the external wall forming member 1. The length of the support panel 2 is several times greater than the length of the external wall forming member 1, so that a plurality of external wall forming members 1 can be secured by the support panel 2.

In FIGS. 2 and 3, when the bricks for an external wall of a building structure are to be laid, a first (bottom) support panel 2 is placed on a bottom reference surface and a plurality of support panels 2 are then stacked one by one so that the second engaging member 8 of the upper support panels 2 rests on the first engaging member 7 of the lower support panels 2. The support panels 2 are appropriately secured or fixed to a structural member of a building structure.

The external wall forming members 1 are then inserted between the first and second engaging members 7 and 8 of the support panels 2, pushing the upper lateral extension 3 of the external wall forming member 1 into a space defined by the first engaging member 7 and the upper finger 5 so that the upper lateral extension 3 upwardly pushes the first engaging member 7 to causes the latter to be elastically deformed, and pushing the lower lateral extension 4 toward the back plate 2*a* within the second engaging member 8. As a result, the external wall forming member 1 is clamped between the first and second engaging members 7 and 8 and held by the mutually inwardly bent fingers 5 and 6.

In each of the support panels 2, the first and second securing members 7 and 8 are integrally formed with the back plate 2*a* as a unit, and therefore, the distance between the first and second engaging members 7 and 8 is maintained constant even when a plurality of support panels 2 are vertically stacked. Therefore, when the external wall forming members 1 are to be laid, the external wall forming members 1 can be easily inserted between the first and second engaging members 7 and 8 while the position of the external wall forming members 1 is automatically ensured. The construction of the support panel 2 bent in the C-shape is very simple. Therefore, it is possible to easily complete an external wall of a building structure, using the external wall forming members 1 and the simple support panels 2. This operation is repeated and a jointing material such as mortar is fitted between the external wall forming members 1 over the fingers 5 and 6 to complete the external wall.

In the prior art, it is possible to use horizontal securing members which may be similar to the first and second engaging members 7 and 8 but which may be fabricated separately from a structural member such as the back plate 2*a*. Such securing members must be attached to the structural member by welding or nails in site, and it is difficult for a bricklayer to attach the securing members to the structural member in an accurate disposition. The present invention can solve this problem. In addition, the external wall forming members 1 do not drop since they are secured, and no accident is caused, during the wall forming work. Therefore, it is possible to easily complete an external wall of a building structure using bricks, and the working efficiency is improved.

Figure 4:
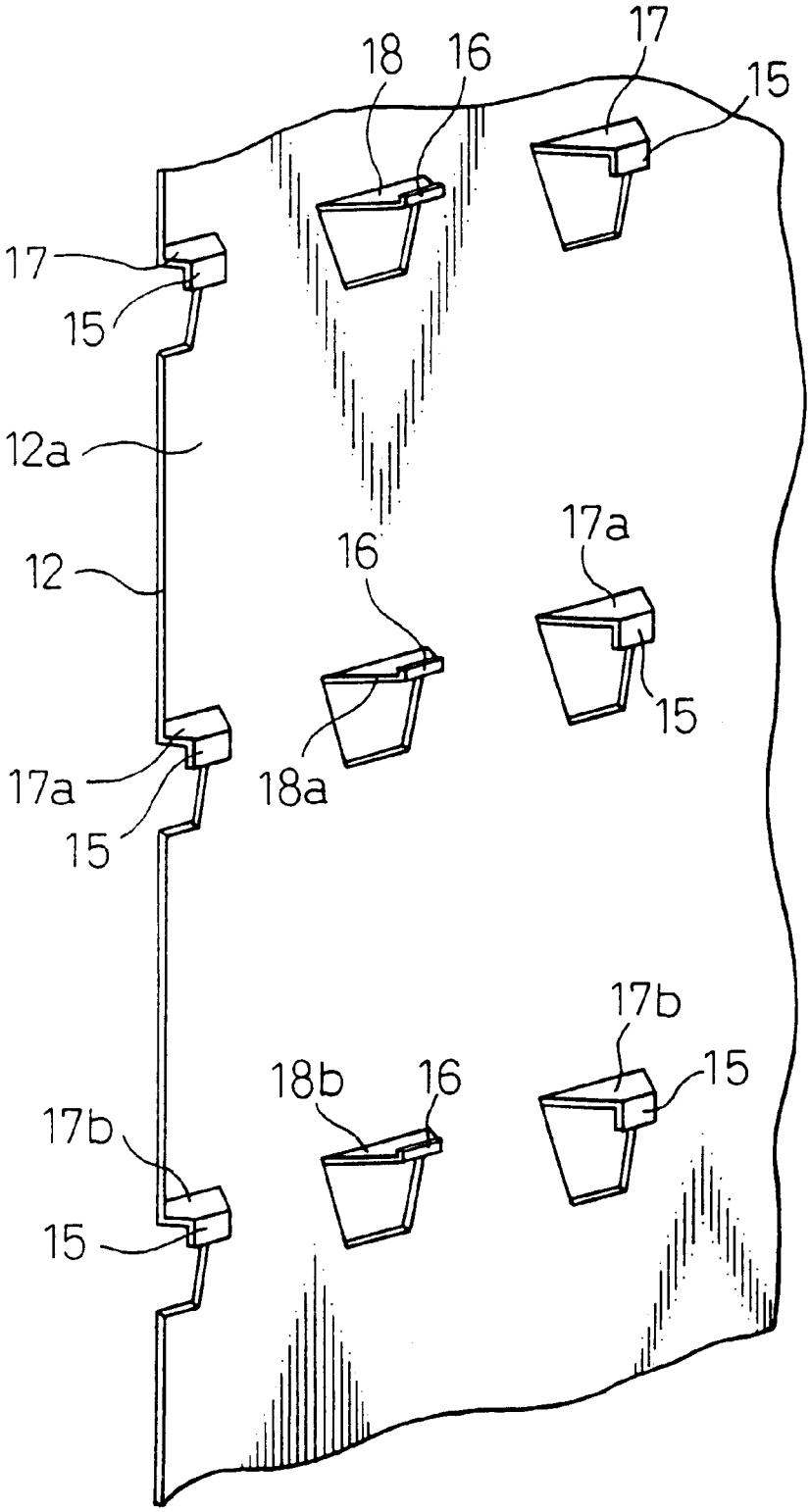
FIG. 4 is a perspective view of a support panel according to the second embodiment of the present invention.
Figure 5:
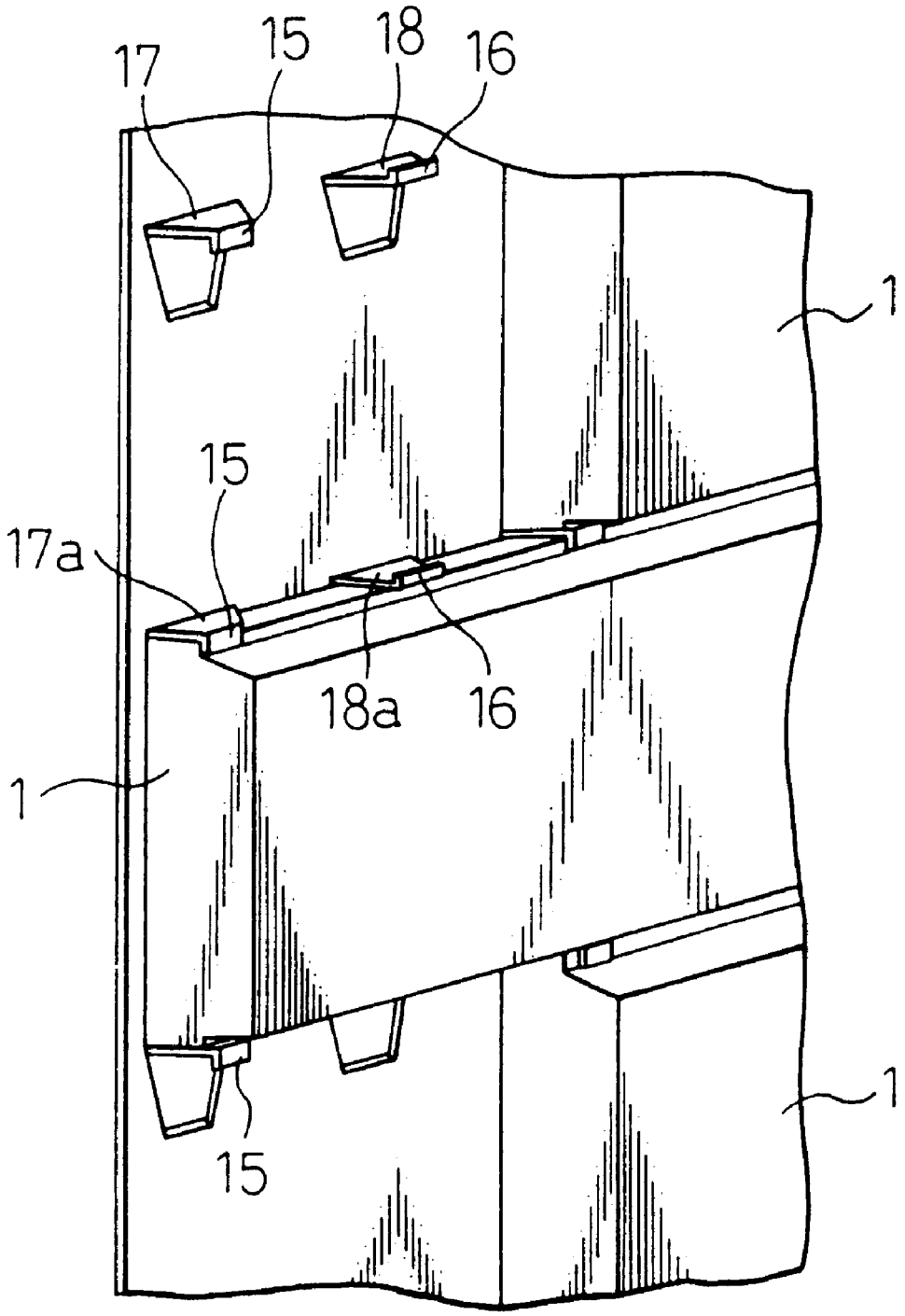
FIG. 5 is a perspective view of the support panel of FIG. 4 and external wall forming members of FIG. 1 secured to the support panel.

FIGS. 4 and 5 show the second embodiment of the present invention. FIG. 4 shows a support panel 12, and FIG. 5 shows the support panel 12 to which a plurality of external wall forming members 1 are secured. The external wall forming member 1 is identical to that shown in FIG. 1. The support panel 12 is formed by pressing a flat metal sheet, so that the support panel 12 includes a back plate 12*a*, and a plurality of engaging members having bent fingers 15 and 16.

A first row of engaging members 17 and 18 extend substantially perpendicular to the back plate 12*a* and along a first line, the engaging members 17 and 18 having fingers 15 and 16 bent at the free end thereof. A second row of engaging members 17*a* and 18*a* extend substantially perpendicular to the back plate 12*a* and along a second line parallel to the first line, the engaging members 17*a* and 18*a* having fingers 15 and 16 bent at the free end thereof. A third row of engaging members 17*b* and 18*b* extend substantially perpendicular to the back plate 12*a* and along a third line parallel to the second line, the engaging members 17*b* and 18*b* having fingers 15 and 16 bent at the free end thereof.

Therefore, a plurality of external wall forming members 1 are secured between the first row of engaging members 17 having fingers 15 and the second row of engaging members 18*a* having fingers 16, and a plurality of external wall forming members 1 are secured between the second row of engaging members 17*a* having fingers 15 and the third row of engaging members 18*b* having fingers 16, as shown in FIG. 5. It is to be noted that three rows of engaging members are shown in the drawings but it is possible to add further rows of engaging members in a similar way.

In this embodiment, the fingers 15 of the first row of engaging members 17 and the fingers 16 of the second row of engaging members 18*a* are mutually inwardly bent, and the engaging members 17 and the engaging members 18*a* are arranged in a staggered arrangement. Also, the fingers 15 of the second row of engaging members 17*a* and the fingers 16 of the third row of engaging members 18*b* are mutually inwardly bent and are arranged in a staggered arrangement. It can be seen that a plurality of engaging members 17 and 18, (17*a* and 18*a*, and 17*b* and 18*b*) are arranged per one external wall forming member. A plurality of engaging members of each of first to third rows of engaging members 17 and 18, 17*a* and 18*a*, and 17*b* and 18*b* have a first group of fingers 15 bent in one direction and a second group of fingers 16 bent in the direction opposite to the one direction.

The operation to arrange the external wall forming members 1 in the support panel is similar to that of the previous embodiment.

FIGS. 6 to 13 show the third embodiment of the present invention. This embodiment includes a support panel 12 which is also fabricated from a flat metal sheet by pressing the latter, so that the support panel 12 includes a back plate 12*a*, and first to fifth rows of engaging members 17 and 18 which extend perpendicular to the back plate 12*a* and along first to fifth parallel lines, respectively. The engaging members 17 have bent fingers 15 and the engaging members 18 have bent fingers 16. The arrangement of the engaging members 17 and 18 is similar to that of the engaging member 17 and 18, 17*a* and 18*a*, and 17*b* and 18*b* in FIGS. 4 and 5. length L of the support panel 12 is 1218 mm or 2437 mm, and the height (or width) is 462 mm.

In this embodiment, cutouts 12*a* and 12*b* are formed adjacent to the engaging members 17 and 18, since the engaging members 17 and 18 are formed by pressing. (cutouts are also formed in FIGS. 4 and 5). The cutouts 12*a* adjacent to the engaging members 17 having the first group of fingers 15 are located on one side of the line along which the engaging members 17 and 18 extend, and the cutouts 12*c* adjacent to the engaging members 18 having the second group of fingers 16 are located on the other side of said line. By this arrangement, it is possible to most easily form the engaging members 17 and 18 having the fingers 15 and 16. That is, only the portions 15*a* and 16*a* (see FIG. 7) corresponding to the fingers 15 and 16 is first pressed downwardly relative to the flat sheet (back plate 12a) and the remaining portions corresponding to the fingers 15 and 16 are then pressed upwardly relative to the flat sheet. All the engaging members 17 and 18 having the fingers 15 and 16 can be fabricated at once.

In addition, the back plate 12*a* is corrugated to form a groove 12*d* between the two adjacent rows of engaging members 17 and 18, the groove 12*d* contributing to increase rigidity of the support panel 12 against a transverse bending force. It is also possible to arrange nails at the position of the grooves 12*d* to attach the back plate 12*a* to a structural member of a building, so that the heads of nails are arranged in the grooves 12*d* and below the external wall forming members 1.

Figure 6:
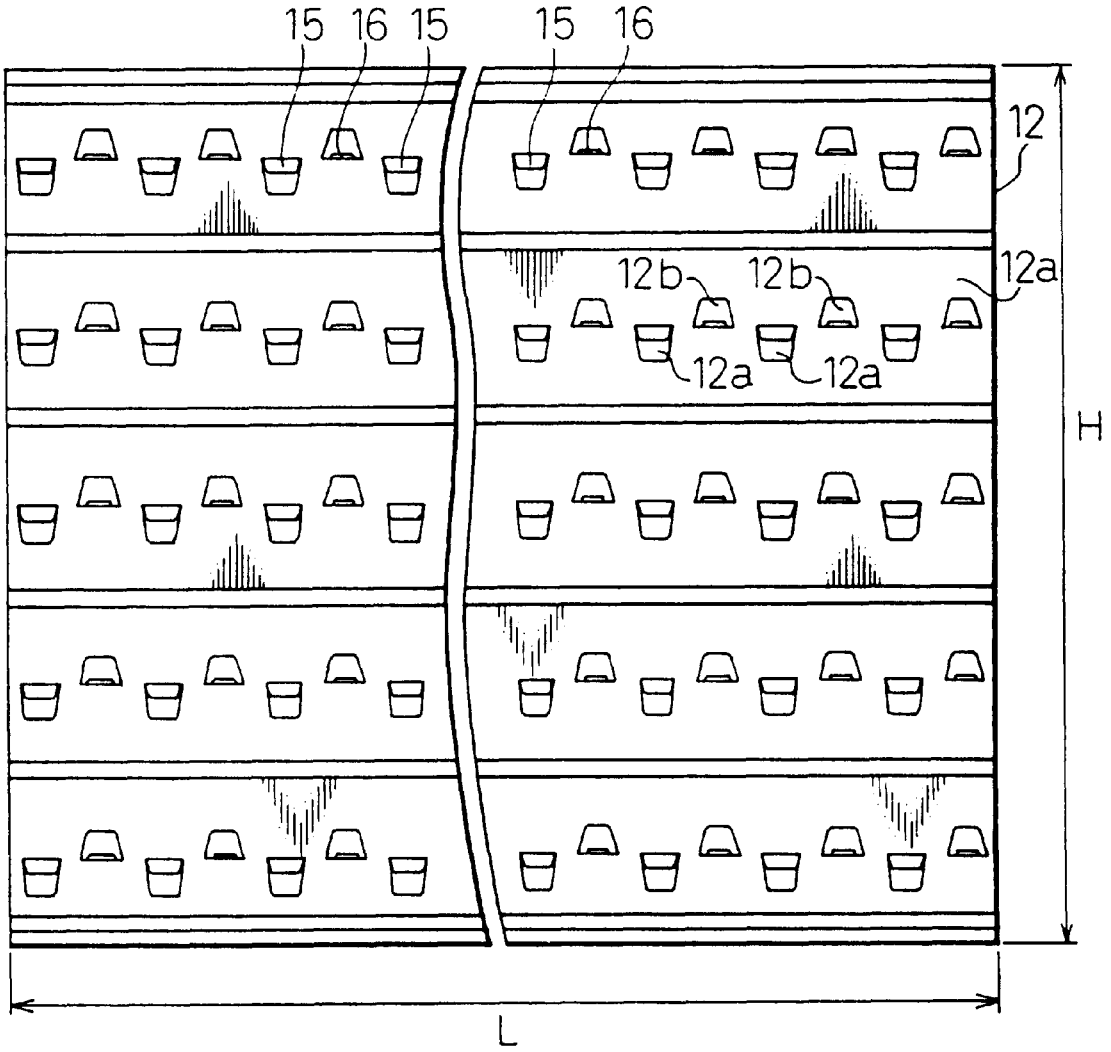
FIG. 6 is a plan view of a support panel according to the third embodiment of the present invention.

The support panel 12 has a bent upper end 12*e* (FIGS. 6 and 8) and a bent lower end, 12*f* (FIG. 6). The support panel 12 can be used with upper and lower support panels 13 and 14, shown in FIGS. 9 and 10. The upper support panel 13 comprises a back-plate 13*a*, a bent end 13*b*, engaging members 13*c* identical to the engaging members 17 of the central support panel 12, and two grooves 13*d*. Also, the lower support panel 14 comprises a back plate 14*a*, a bent end 14*b*, engaging members 14*c* identical to the engaging members 18 of the support panel 12, and two grooves 14*d*.

The engaging members 13c have longer fingers 13*e*, while the engaging members 14*c* have shorter fingers 14*e*. In use, the upper support panel 13 is arranged above the central support panel 12 to terminate the support system at the top thereof, so that the bent end 13*b* abuts against the bent upper end 12*e* and the engaging members 13*c* having longer fingers 13*e* coact with the uppermost row of the engaging members 18 having the shorter fingers 16 of the central support panel 2, to thereby secure a plurality of the external wall forming members 1 therebetween. The upper support panel 13 is arranged below the central support panel 12 to terminate the support system at the bottom thereof, so that the bent end 14*b* abuts against the bent lower end 12*f* of the central support panel 12 and the engaging members 14*c* having shorter fingers 14*e* coact with the lowermost row of the engaging members 17 having the longer fingers 15 of the central support panel 2, to thereby secure a plurality of the external wall forming members 1 therebetween.

Figure 11:
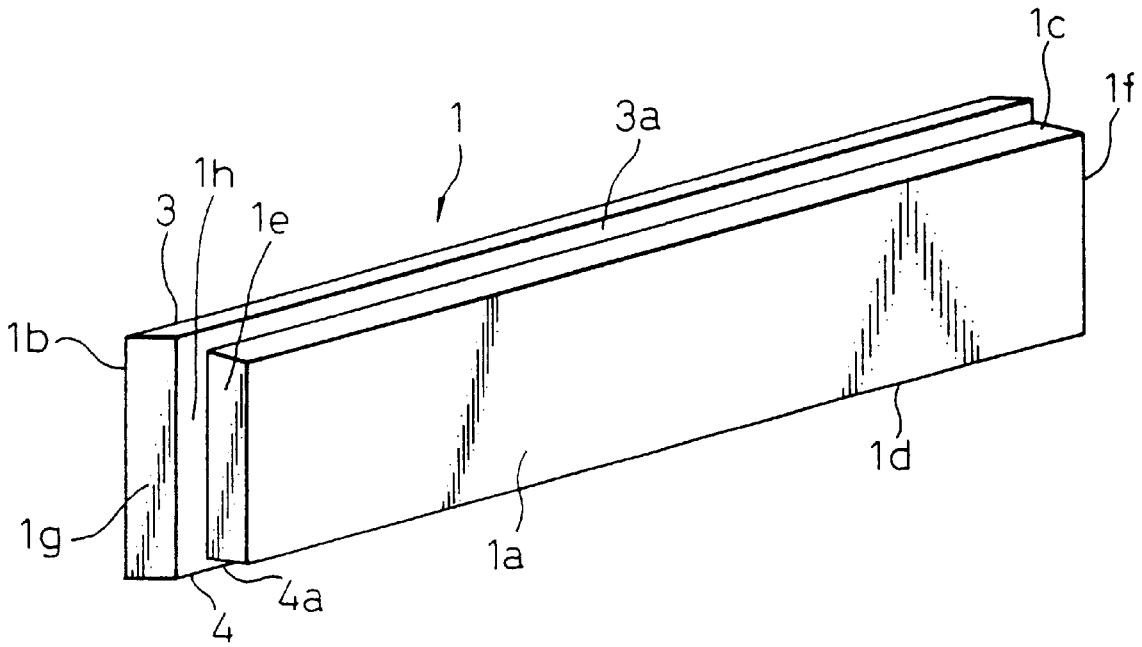
FIG. 11 is a perspective view of another example of an external wall forming member.

FIG. 11 shows another example of the external wall forming member 1 which has a generally rectangular parallelepiped shape, elongated lateral extensions 3 and 4, and an end extension 1*g*. The external wall forming member 1 has a main surface 1*a*, a rear surface 1*b*, side surfaces 1*c* and 1*d*, and end surfaces 1*e* and 1*f*. The elongated lateral extensions 3 and 4 project on the side surfaces 1*c* and 1*d*, and have minor surfaces 3*a* and 4*a*, side surfaces, and rear surfaces flush with the rear surface 1*b*. The end extension 1*g* projects on one of the end surfaces 1*e* and 1*f*, and has a minor surface 1*h*, side surfaces and rear surfaces. The main surface 1*a* is higher than the minor surfaces 3*a*, 4*a* and 1*h*. The width of the upper lateral extension 3 is greater than that of the lower lateral extension 4. The minor surfaces 3*a*, 4*a* and 1*h* are continuous and flush with each other. The rear surfaces of the elongated lateral extensions 3 and 4 and the end extension 1*g* are continuous and flush with the rear surface 1*b*.

Figure 7:
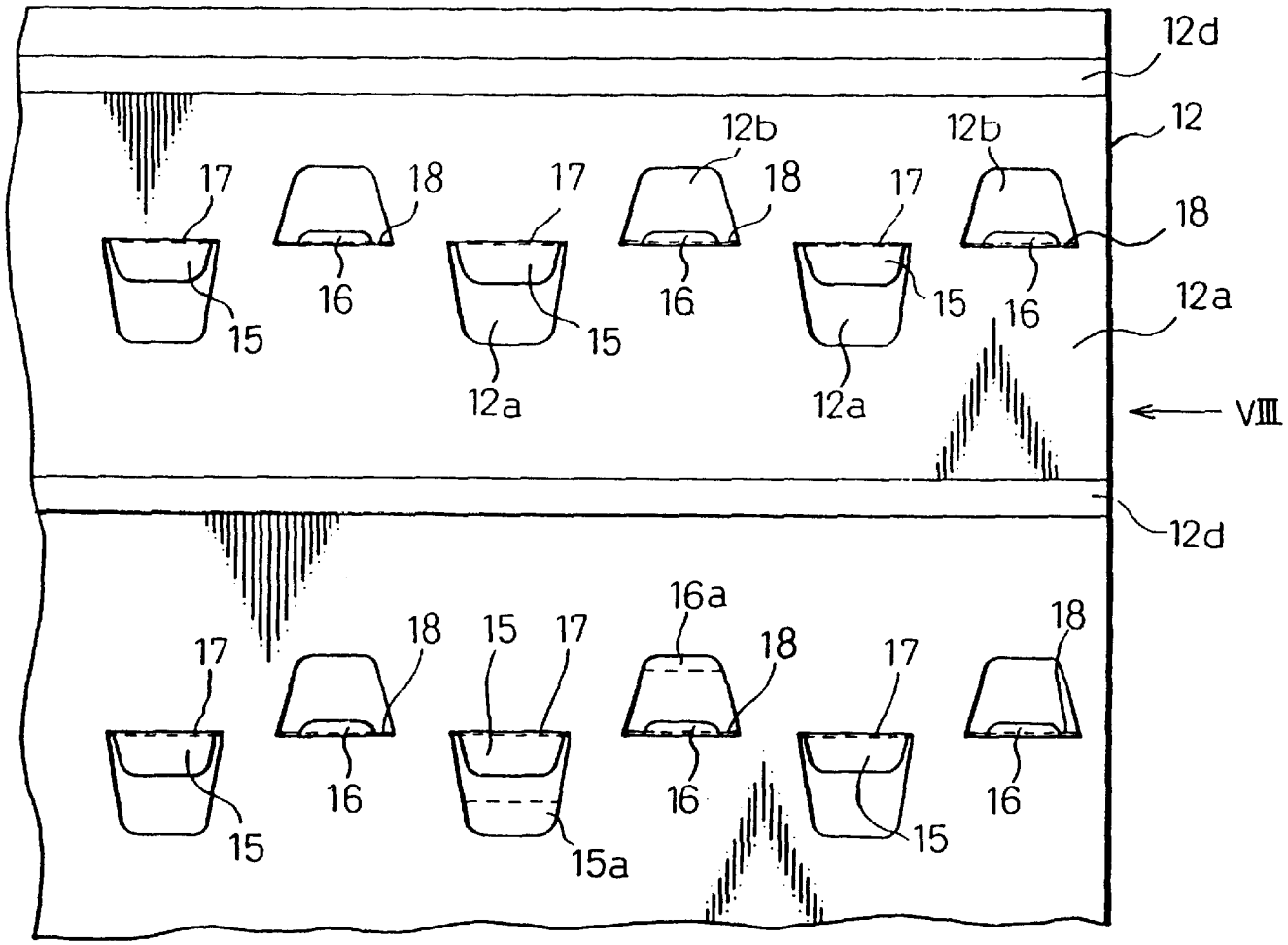
FIG. 7 is an enlarged view of a portion of the support panel of FIG. 6.
Figure 8:
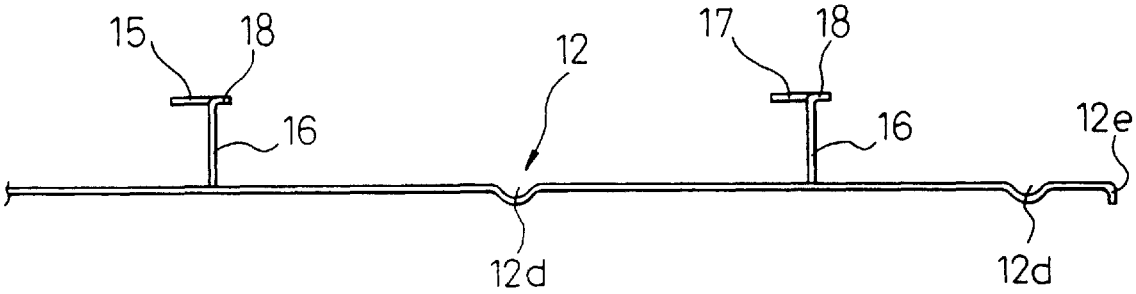
FIG. 8 is an end view of the support panel of FIG. 7, viewed in the arrow VIII in FIG. 8.
Figure 9:
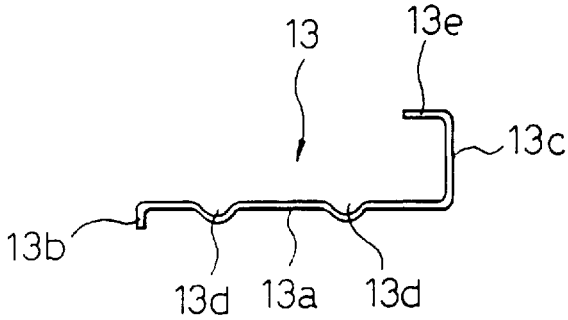
FIG. 9 is an end view of an upper support panel used with the central support panel of FIG. 8.
Figure 10:
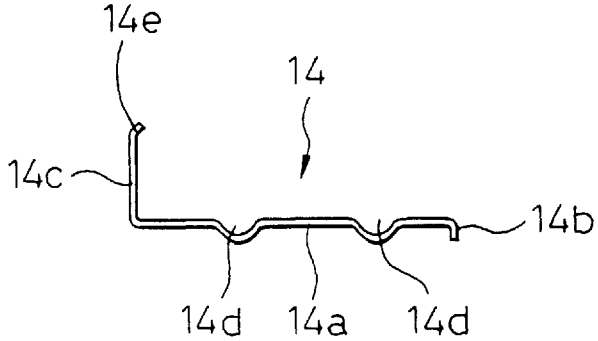
FIG. 10 is an end view of a lower support panel used with the central support panel of FIG. 8.
Figure 12:
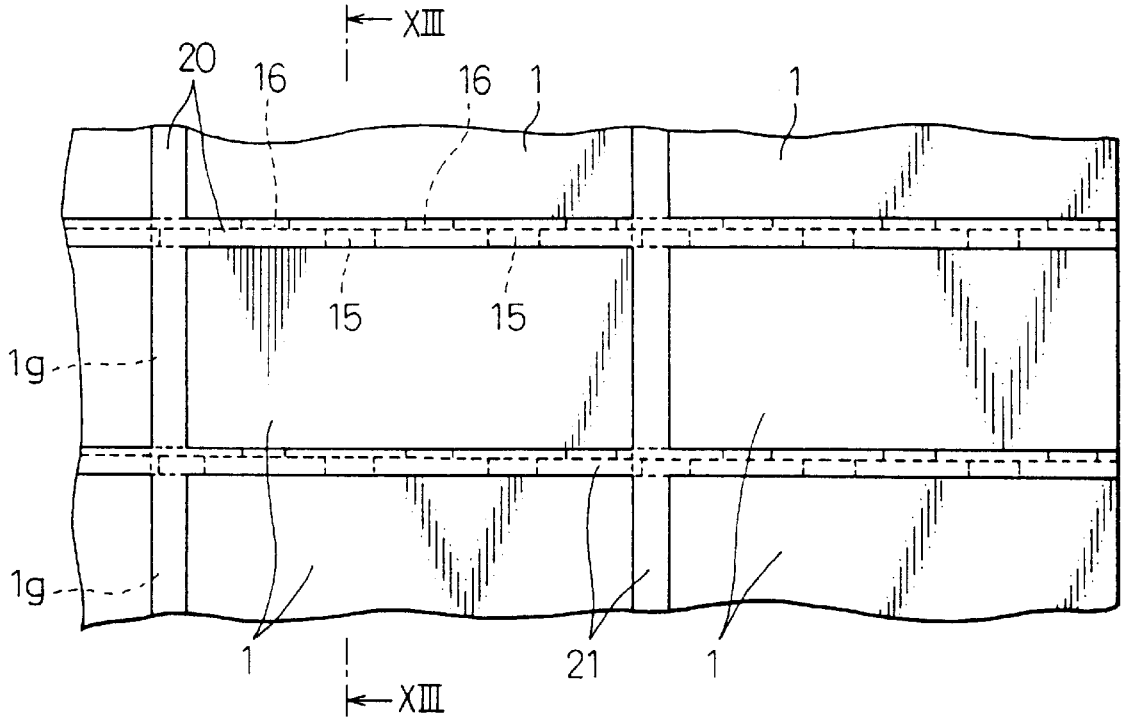
FIG. 12 is a plan view of an external wall completed by the external wall forming members of FIG. 11 and the support panel of FIGS. 6 to 8.
Figure 13:
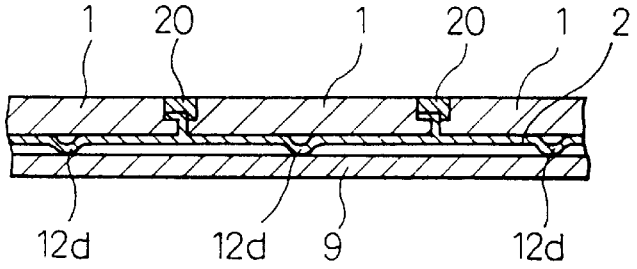
FIG. 13 is a cross-sectional view of the external wall of FIG. 12, taken along the lines XIII—XIII in FIG. 12.

FIGS. 12 and 13 show an external wall including the external wall forming members 1 of FIG. 11 and the support panel 2 of FIGS. 6 to 8. The support panel 2 is attached to a structural member 9 of a housing or a building structure, using nails arranged at the grooves 12*d*. The external wall forming members 1 are secured between the engaging members 17 and 18 having fingers 15 and 16 of the support panel 2, as described above. A jointing material 20 such as mortar is fitted in a gap formed between the bodies of the adjacent external wall forming members 1 and above the lateral extensions 3 and 4 of the external wall forming members 1 and the fingers 15 and 16 of the support panel 12. Therefore, the support panel 2 is hidden by the jointing material 20.

It is to be noted that a gap is also formed between the bodies of the adjacent external wall forming members 1 above the end projection 1*g* of the external wall forming members 1, and a jointing material 20 can be filled in this gap. Therefore, it is possible to arrange two adjacent external wall forming members 1 in an end-to-end abutment relationship, which further facilitates arranging the external wall forming members 1 in position. If the external wall forming members 1 do not have end extensions 1*g*, it is necessary to arrange two adjacent external wall forming members 1 with a slight distance to form a gap between them so that the jointing material 20 can be filled in that gap.

Figure 14:
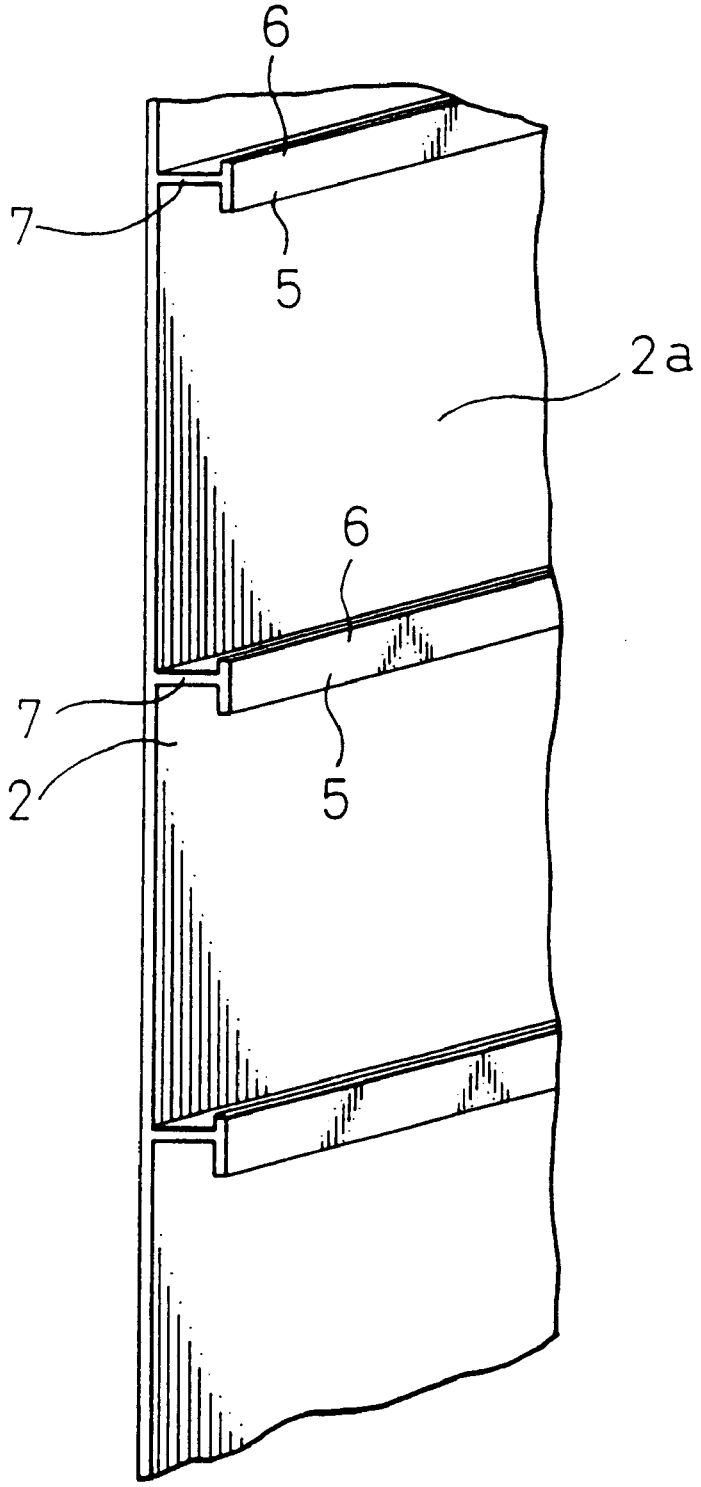
FIG. 14 is a perspective view of a support panel according to the fourth embodiment of the present invention.
Figure 15:
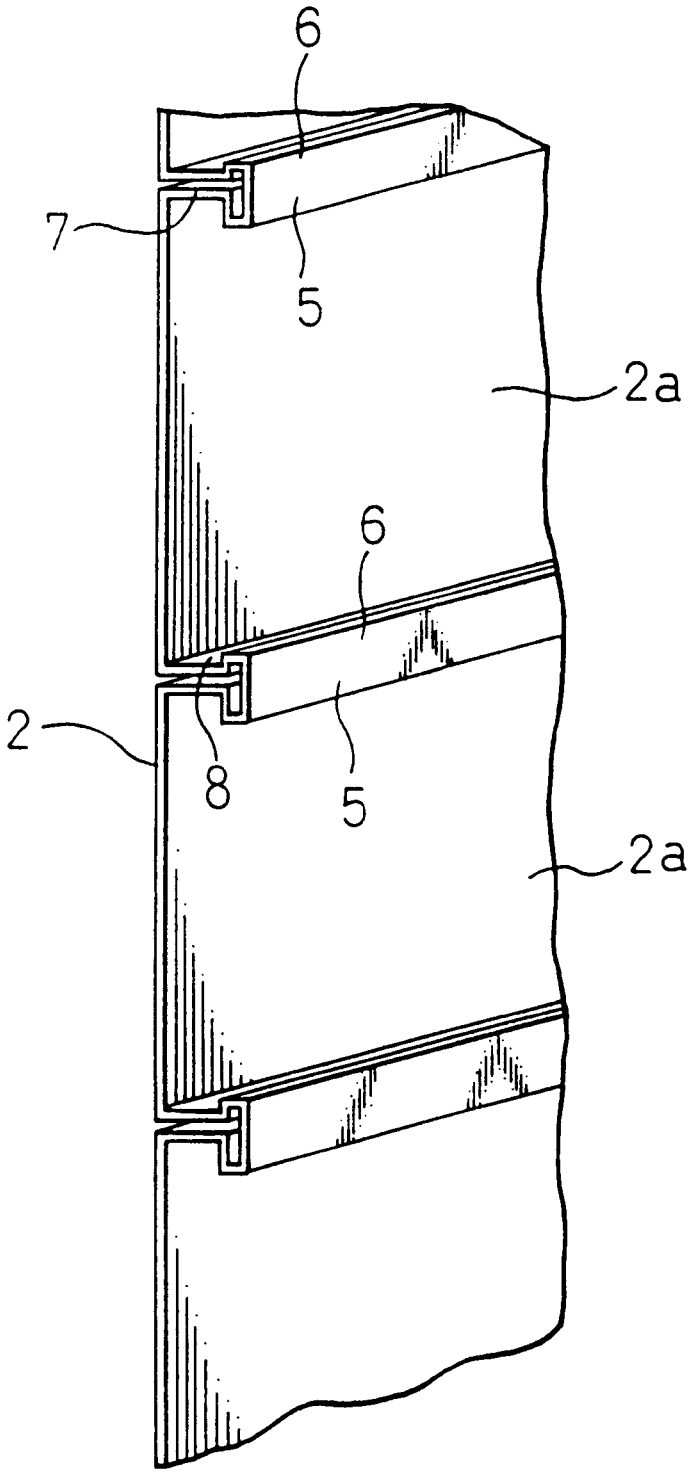
FIG. 15 is a perspective view of a support panel according to the fifth embodiment of the present invention.

FIGS. 14 and 15 show further embodiments similar to that of FIG. 2. FIG. 14 shows that the support panel 2 is made by aluminum extrusion molding. In FIG. 2, the support panels 2 are made separately one by one and joined together. FIG. 15 shows that the support panel 2 (which corresponds to a plurality of the support panels 2 of FIG. 2) is made by continuously and repeatedly bending a flat sheet metal.

Figure 16:
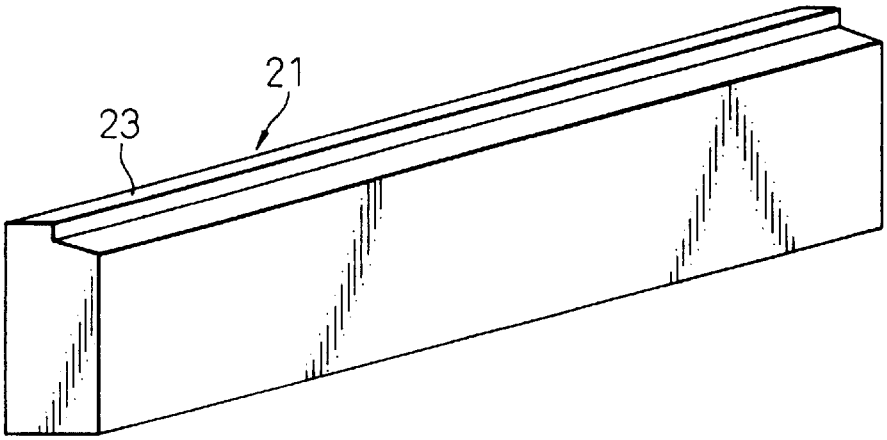
FIG. 16 is a perspective view of a further example of an external wall forming member.
Figure 17:
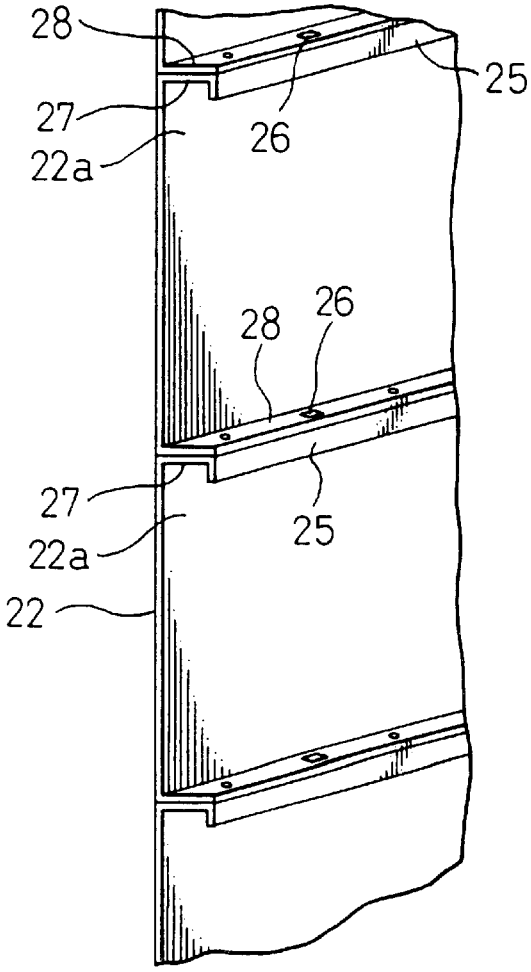
FIG. 17 is a perspective view of a support panel according to a further embodiment of the present invention, which is adapted for use with the external wall forming members of FIG. 16.
Figure 18:
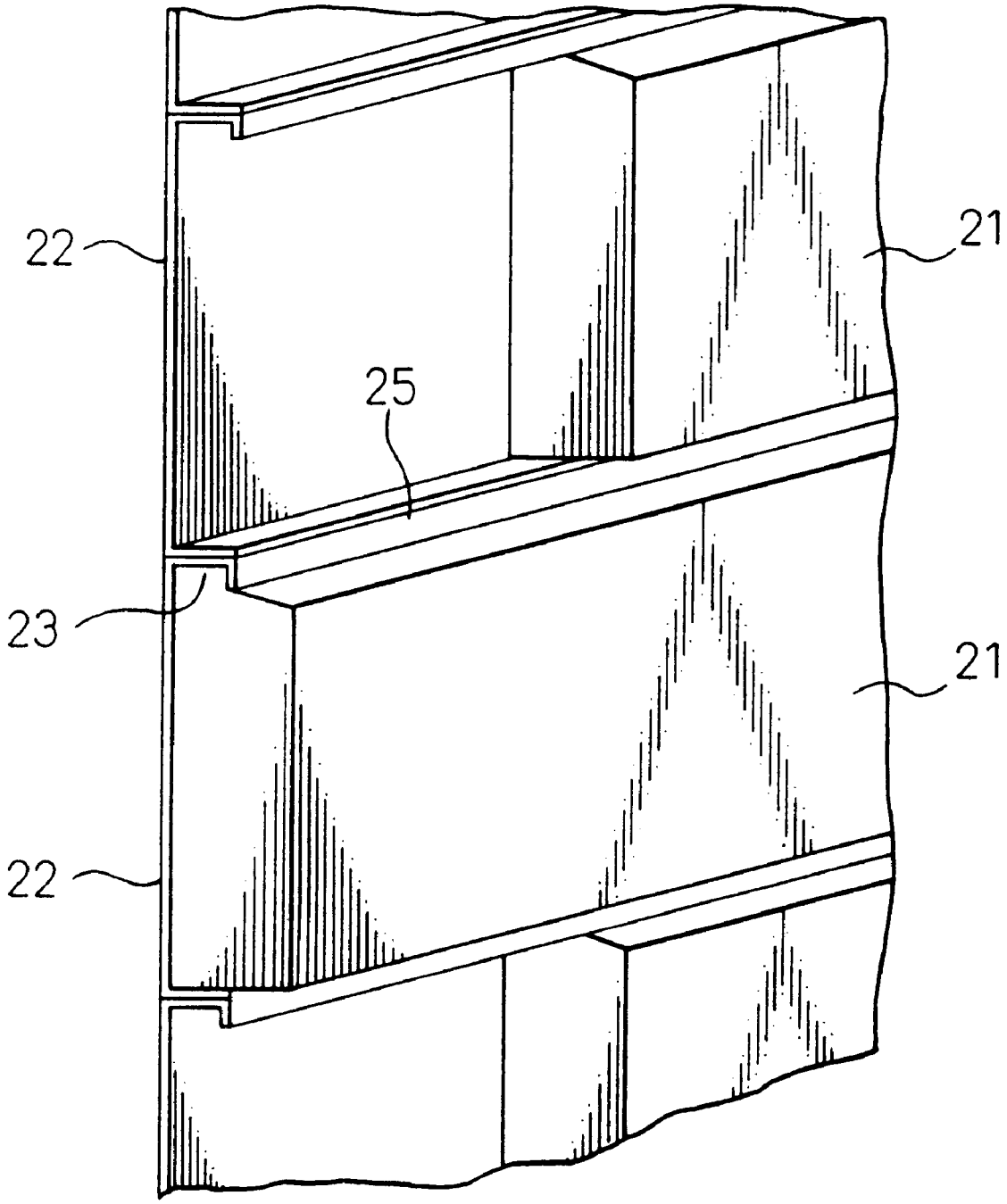
FIG. 18 is a perspective view of the support panel of FIG. 17 and the external wall forming members of FIG. 16.

FIGS. 16 to 18 show a further embodiment of the present invention. FIG. 16 shows an external wall forming member 21 having only one elongated lateral extension 23. Similar to the external wall forming member 1 in the previous embodiments, the external wall forming member 21 is a generally rectangular parallelepiped shaped brick, and has the external wall forming member 21 has a main surface, a rear surface, side surfaces, and end surfaces. The elongated lateral extension 23 is arranged only on one of the side walls. The lateral extension 23 is located on the upper side of the external wall forming member 21 when it is vertically arranged. The external wall forming member can have the end extension 1g of FIG. 11.

FIG. 17 shows support panels 22 which are fabricated from a flat sheet metal by twice bending the latter in a similar way to the support panels 2 of FIG. 2. Therefore, the support panel 22 has a back plate 22*a* adapted to make contact with the rear surface of the external wall forming member 21, a first engaging member 27 extending substantially perpendicular to the back plate 22*a* and along a first line, and a second engaging member 28 extending substantially perpendicular to the back plate 20*a* and along a second line parallel to the first line. The first and second engaging members 27 and 28 are integrally formed with the back plate 20*a* as a unit.

The first engaging member 27 has the bent finger 25 to hold the upper lateral extension 23, and the second engaging member 28 has elastic members 26 to elastically engage with the bottom of the external wall forming member 21. The elastic members 26 are formed by pressing or punching the material of the second engaging member 28 so that a portion of the elastic members 26 near the free end of the second engaging member 28 is left uncut and the remaining portion is cut. The cut portion near the back plate 22*a* is raised to incline relative to the second engaging member 28. The length of the support panel 22 is several times greater than the length of the external wall forming member 21, so that a plurality of external wall forming members 21 can be secured by the support panel 22.

When the bricks for an external wall of a building structure are to be laid, a first (bottom) support panel 22 is placed on a bottom reference surface and a plurality of support panels 22 are then stacked one by one, in a similar way to the embodiment of FIGS. 1 to 3. The external wall forming members 11 are then inserted between the first and second engaging members 27 and 28 of the support panels 22, pushing the upper lateral extension 23 of the external wall forming member 21 toward the first engaging member 27 and pushing the bottom of the external wall forming members 21 toward the back plate 22*a*. The elastic members 26 are elastically deformed and frictionally engage with the external wall forming member 21. As a result, the external wall forming member 21 is clamped between the first and second engaging members 27 and 28 and held by the finger 25 and the elastic members 26.

Therefore, when the external wall forming members 1 are to be installed, the external wall forming members 21 can be easily inserted between the first and second engaging members 27 and 28 while the position of the external wall forming members 21 is automatically ensured. The construction of the support panel 22 is very simple, and it is possible to easily complete an external wall of a building structure, using the external wall forming member 21 and the support panels 22. This operation is repeated and a jointing material such as mortar is fitted between the external wall forming members 21 over the fingers 25 to complete the external wall. In addition, the external wall forming members 21 do not drop since they are secured, and no accident is caused, during the wall building work. Therefore, it is possible to easily complete an external wall of a building structure, using bricks, and the working efficiency is improved.

The elastic members 26 on the lower securing members 28 can be modified as desired. For example, the elastic members 26 can be replaced by simple projections, or the projections can be arranged on the external wall forming members 21. It is not necessary to provide with the elastic members 26 or the projections, and they can be omitted depending on the dimension between the securing members 27 and 28.

Figure 19:
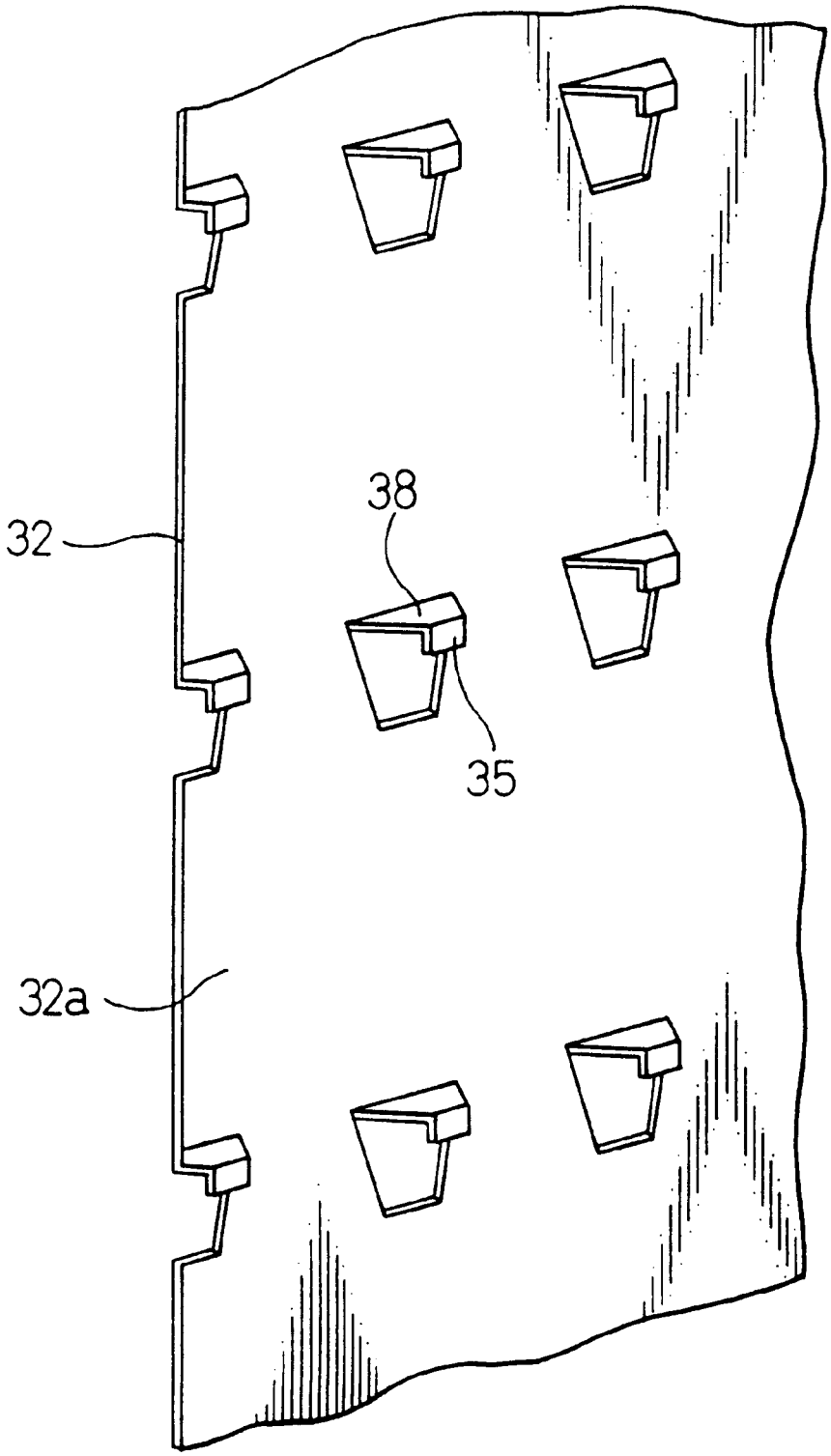
FIG. 19 is a perspective view of a support panel according to a further embodiment of the present invention.
Figure 20:
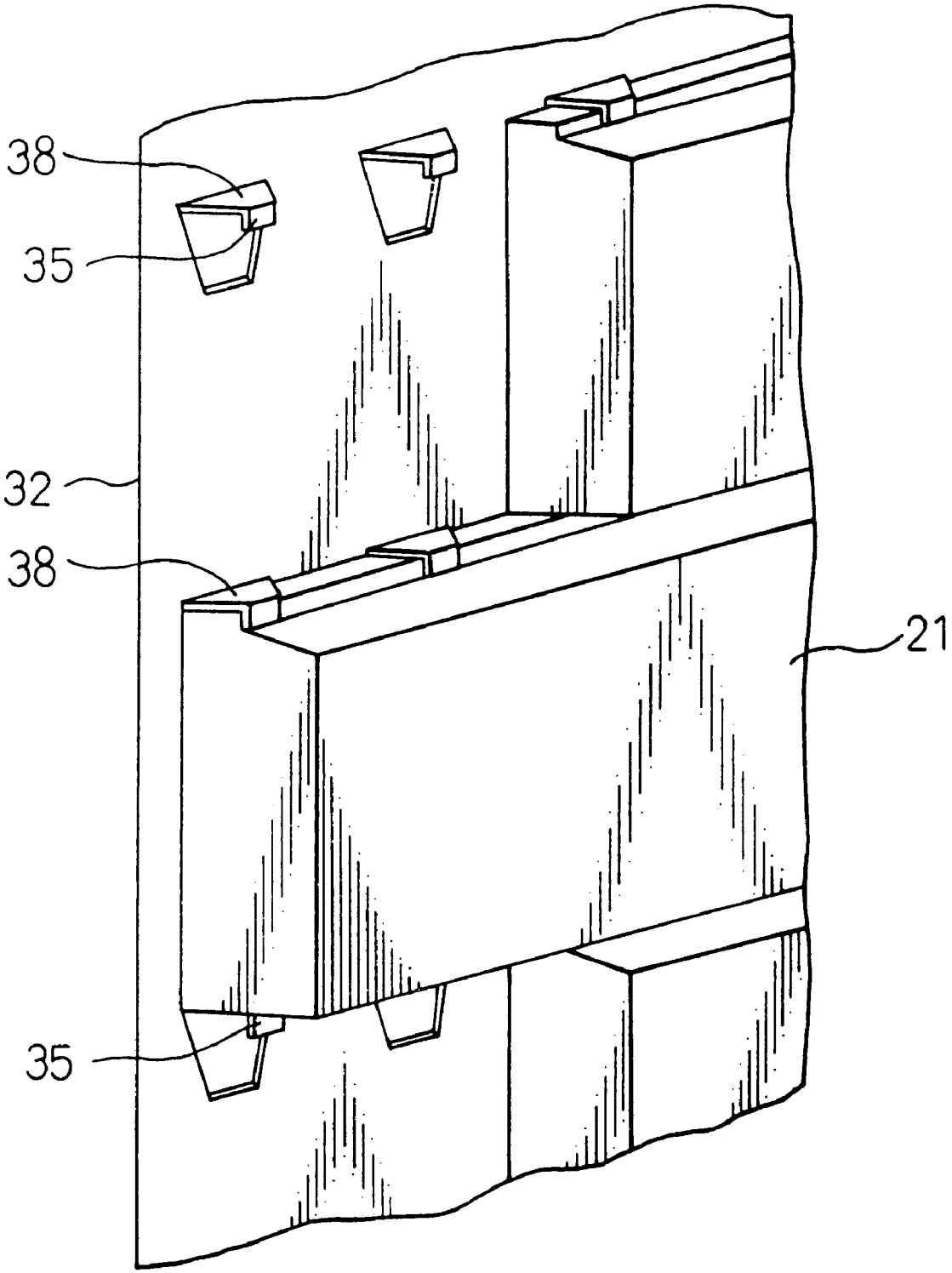
FIG. 20 is a perspective view of the support panel of FIG. 19 and the external wall forming members of FIG. 16.

FIGS. 19 and 20 show a further embodiment of the present invention. FIG. 19 shows a support panel 32, which is fabricated from a flat sheet metal by pressing the latter in a similar way to that of FIG. 4, and FIG. 20 shows the support panel 32 to which a plurality of external wall forming members 21 of FIG. 16 are secured. The support panel 32 has a back plate 32*a* and several rows of engaging members 38 extending substantially perpendicular to the back plate 32*a* and along parallel lines, respectively. The engaging members 38 have downwardly bent fingers 35 at the free ends thereof. In each row, the bending angle of the engaging member 38 is alternately changed; one is perpendicularly bent relative to the back plate 32*a*, and the adjacent one is bent at an obtuse angle relative to the back plate 32*a* (i.e., the latter engaging member 38 is directed slightly upward). This arrangement is staggered between two adjacent rows. However, this arrangement is not necessary.

A plurality of external wall forming members 21 are secured between the adjacent rows of engaging members 38, pushing the upper lateral extension 23 of the external wall forming member 21 toward the upper engaging members 38 and pushing the bottom of the external wall forming members 21 toward the back plate 32*a*. The external wall forming members 21 can be secured by the fingers 35, and are pinched by the upper engaging members 38 and the lower, upwardly bent engaging members 38 since the every two engaging members 38 are upwardly bent. Therefore, this embodiment has advantages similar to those of the previous embodiments.

Figure 21:
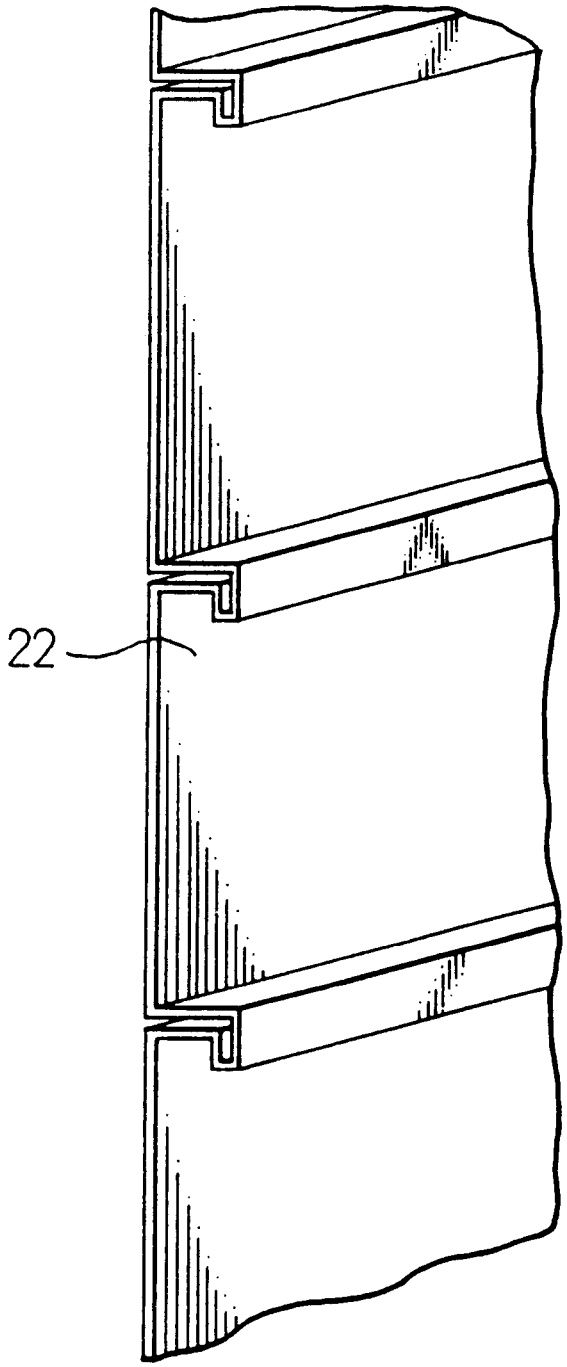
FIG. 21 is a perspective view of a support panel according to a further embodiment of the present invention.
Figure 22:
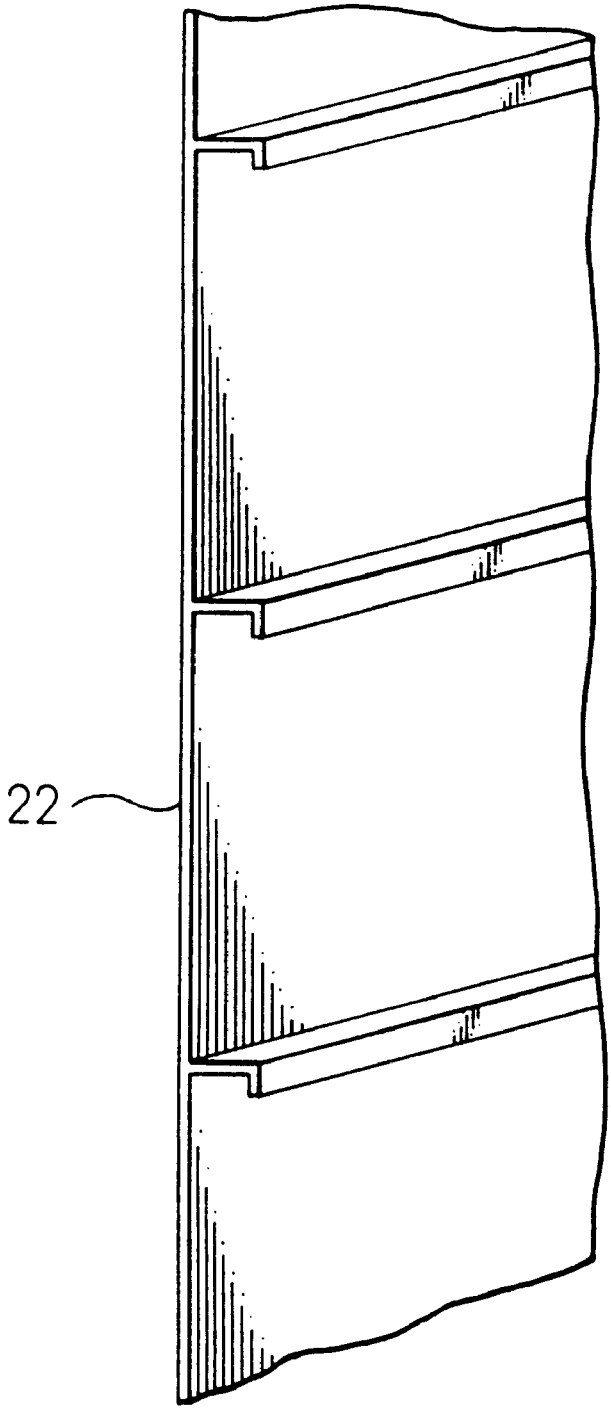
FIG. 22 is a perspective view of a support panel according to a still further embodiment of the present invention.

FIGS. 21 and 22 show further embodiments adapted for use with the external wall forming members 21 of FIG. 16. In FIG. 21, the support panel 22 is made by repeatedly bending sheet metal to integrally form several blocks. In FIG. 22, the support panel 22 is made of an aluminum extrusion molding.

In the above described embodiments, the external wall forming members 1, 11, and 21 are brisks. However, the present invention is not limited to the bricks, and it is possible use other materials such as tiles or stones or other materials.

As described in greater detail, it is possible to safely and reliably arrange external wall forming members onto an external structure of a building even if the external wall forming members are relatively heavy members such as bricks. Since the support panel has a constant shape, and since the support panel(s) has a considerable length and the securing members can be arranged in many rows, the position of the external wall forming members 21 is automatically ensured only by appropriately positioning the bottom of the support panel(s). The position of the external wall forming members 21 is automatically ensured even when a plurality of support panels are stacked. The support panel(s) can be fabricated by bending or pressing and is simple in construction, and is less expensive. The external wall forming members do not drop since they are secured by the support panel, and no accident is caused, during the wall forming work. Therefore, it is possible to easily complete an external wall of a building structure, using external wall forming members such as bricks, and the working efficiency is improved.

What is claimed is:

1. A support panel for supporting a plurality of external wall forming members, each external wall forming member having a generally rectangular parallelpiped shape including a main surface, a rear surface, side surfaces, and elongated lateral extensions projecting on said side surfaces, said elongated lateral extensions having minor surfaces and rear surfaces, said main surface being higher than said minor surfaces, said support panel comprising:

a back plate adapted to make contact with the rear surface of an external wall forming member;

a plurality of first engaging members extending substantially perpendicular to said back plate and arranged along a first line;

a plurality of second engaging members member extending substantially perpendicular to said back plate and arranged along a second line parallel to said first line;

said first engaging members and said second engaging members being integrally formed with said back plate as a unit so that a plurality of external wall forming members can be secured between said first and second engaging members;

said first engaging members comprising engaging members having first fingers bent toward said second line and engaging members having second fingers bent opposite to said first fingers, said engaging members having said first fingers and said engaging members having said second fingers being arranged alternately;

said second engaging members comprising engaging members having third fingers bent toward said first line and engaging members having fourth fingers bent opposite to said third fingers, said engaging members having said third fingers and said engaging members having said fourth fingers being arranged alternately; and said back plate having cutouts formed therein by pressing the material of said back plate to form said first and second engaging members with said first, second, third, and fourth fingers, each one of said cutouts being located adjacent to an associated one of said first and second engaging members on the side thereof toward which associated one of said first, second, third and fourth fingers is bent.

2. A support panel according to claim 1, further comprising at least one third engaging member extending substantially perpendicular to said back plate and along a third line parallel to said second line parallel, said at least one third engaging member being integrally formed with said back plate, said at least one first engaging member and said at least one second engaging member as a unit, whereby a plurality of external wall forming members being secured between said at least one second engaging member and said at least one third engaging member.

3. A support panel according to claim 2, wherein said at least one first engaging member and said at least one second engaging member have mutually inwardly bent fingers to engage with said minor surfaces of a plurality of external wall forming members inserted between said at least one first engaging member and said at least one second engaging member, said at least one second engaging member and said at least one third engaging member have mutually inwardly bent fingers to engage with said minor surfaces of a plurality of external wall forming members inserted between said at least one second engaging member and said at least one third engaging member.

4. A support panel according to claim 2, wherein said back plate is corrugated to form at least one groove between said first and second lines and to form at least one groove between said second and third lines.

5. A support panel according to claim 1, wherein said support panel is formed by pressing.

6. A support system for supporting a plurality of external wall forming members support system, each external wall forming member having a generally rectangular parallelepiped shape including a main surface, a rear surface, side surfaces, and elongated lateral extensions projecting on said side surfaces, said elongated lateral extensions having minor surfaces and rear surfaces, said main surface being higher than said minor surfaces said support system comprising a central support panel and an upper support panel;

said central support panel comprising:

a back plate adapted to make contact with the rear surface of the external wall forming members;

at least one first engaging member extending perpendicular to said back plate and along a first line;

at least one second engaging member extending substantially perpendicular to said back plate and along a second line parallel to said first line;

at least one third engaging member extending substantially perpendicular to said back plate and along a third line parallel to said second line;

said at least one first engaging member, said at least one second engaging member and said at least one third engaging member, said at least one second engaging member and said at least one third engaging member being integrally formed with said back place as a unit; and wherein said support panel is adapted to secure a plurality of external wall forming members between at least one of said first engaging members and at least one of said second engaging members; and said upper support panel comprising;

a back plate adapted to make contact with the rear surfaces of the external wall forming members;

at least one fourth engaging member extending substantially perpendicular to said back plate and along a fourth line;

said at least one fourth engaging member being integrally formed with said back plate as a unit; and said at least one first engaging member ad said at least one fourth engaging member being adapted to secure a plurality of wall forming members therebetween wherein said upper support panel is arranged adjacent to said central support panel so that said fourth line is parallel to said first line;

wherein a plurality of engaging members are arranged per one external wall forming members;

wherein said first engaging members and said second engaging members have a first group of fingers bent in one erection and a second group of fingers bent in the direction opposite to said one direction;

wherein said engaging members are formed by pressing the material of said back plate so that said engaging members stand on said back plate and cutouts are formed adjacent to said engaging members, wherein said cutouts adjacent to said engaging members having said first group of fingers are located on one side of the line along which said engaging members having said second group of fingers are located on the other side of said line;

wherein said cutouts are formed in a staggered manner so that one cutout is arranged on one side of the line along which the engaging members are arranged, wherein each said engaging members standing on the end wall of said one cutout has a finger bent toward said one cutout and wherein the next cutout is arranged on the other side of said line and each said engaging member standing on the end wall of said next cutout has a finger bent toward said next cutout; and wherein each finger is disposed to oppose a cutout.

7. A support system according to claim 6, further comprising a lower support panel, said lower support panel comprising:

a back plate;

at least one fifth engaging member extending substantially perpendicular to said back plate and along a fifth line;

said at least one fifth engaging member being integrally formed with said back plate as a unit; and whereby a plurality of external wall forming members are secured between said at least one third engaging member and said at least one fifth engaging member when said lower support panel is arranged adjacent to said central support panel so that said fifth line is parallel to said third line.

8. A support panel for supporting a plurality of external wall forming members, each external wall forming member having a generally rectangular parallelpiped shape including a main surface, a rear surface, side surfaces, and elongated lateral extensions projecting on said side surfaces, said elongated lateral extensions having minor surfaces and rear surfaces, said main surface being higher than said minor surfaces, said support panel comprising:

a back plate adapted to make contact with the rear surface of an external wall forming member;

a plurality of first engaging members extending substantially perpendicular to said back plate and arranged along a first line;

a plurality of second engaging members extending substantially perpendicular to said back plate and arranged along a second line parallel to said first line;

said first engaging members and said second engaging members being integrally formed with said back plate as a unit so that a plurality of external wall forming members can be secured between said first and second engaging members;

said first engaging members comprising engaging members having first fingers bent toward said second line and engaging members having second fingers bent opposite to said first fingers, said engaging members having said first fingers and said engaging members having said second fingers being arranged alternately;

said second engaging members comprising engaging members having third fingers bent toward said first line and engaging members having fourth fingers bent opposite to said third fingers, said engaging members having said third fingers and said engaging members having said fourth fingers being arranged alternately; and said back plate having cutouts formed therein by pressing the material of said back plate to form said first and second engaging members with said first, second, third, and fourth fingers, each one of said cutouts being located adjacent to an associated one of said first and second engaging members on the side thereof toward which associated one of said first, second, third and fourth fingers is bent;

wherein said first and second engaging members and associated first, second, third and fourth fingers thereof, each extends from an adjacent cutout formed on said back plate and corresponding in dimension to the adjacent cutout such that a said engaging member and its associated finger corresponds to the cutout dimensions; and wherein each of said first, second, third and fourth fingers is bent for disposition opposite its adjacent cutout and is disposed above its said adjacent cutout.

* * * * *

UNITED STATES PATENT AND TRADEMARK OFFICE

CERTIFICATE OF CORRECTION

PATENT NO. : 6,098,363

DATED : August 8, 2000

INVENTOR(S) : Kazuhiro Yaguchi

It is certified that error appears in the above-identified patent and that said Letters Patent are hereby corrected as shown below:

[73] Assignee: Grand Home Builder Co., Ltd.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO. : 6,098,363
DATED : August 8, 2000
INVENTOR(S) : Kazuhiro Yaguchi

It is certified that error appears in the above-identified patent and that said Letters Patent is hereby corrected as shown below:

Title page,
Item [73], Assignee: Grand Home Builder Co., Ltd.
2-2-9, Higashiiwatuki, Iwatuki-shi
Saitama, Japan Signed and Sealed this Twenty-ninth Day of January, 2002

*Attest:*

*Attesting Officer*

JAMES E. ROGAN
*Director of the United States Patent and Trademark Office*